United States Patent [19]

Zimmer et al.

[11] Patent Number: 4,833,748

[45] Date of Patent: May 30, 1989

[54] METHOD AND DEVICE FOR APPLYING A FLOWABLE SUBSTANCE

[75] Inventors: Johannes Zimmer, Ebentalerstr. 133, A 9020 Klagenfurt; Manfred Gaser, Wöfnitz, both of Austria

[73] Assignee: Johannes Zimmer, Austria

[21] Appl. No.: 870,764

[22] PCT Filed: Aug. 29, 1985

[86] PCT No.: PCT/AT85/00028

§ 371 Date: Jun. 25, 1986

§ 102(e) Date: Jun. 25, 1986

[87] PCT Pub. No.: WO86/01548

PCT Pub. Date: Mar. 13, 1986

[30] Foreign Application Priority Data

Aug. 31, 1984 [AT] Austria ..... 2805/84

[51] Int. Cl.[4] ..... D06B 5/08; D06B 1/08

[52] U.S. Cl. ..... 8/151; 8/158; 68/200; 118/692; 222/56; 239/71; 417/38; 417/45

[58] Field of Search ..... 8/158, 151; 68/200; 118/692, 406; 101/120; 222/56; 239/71, 76; 137/487.5; 417/38, 45

[56] References Cited

U.S. PATENT DOCUMENTS

| | | | |
|---|---|---|---|
| 2,706,520 | 4/1955 | Chandler | 239/76 X |
| 3,985,467 | 10/1976 | Lefferson | 417/45 X |
| 3,994,220 | 11/1976 | Vertegaal | 101/120 X |
| 4,023,487 | 5/1977 | Mitter | 101/120 |
| 4,237,818 | 12/1980 | Clifford et al. | 68/200 X |
| 4,530,463 | 7/1985 | Hiniker et al. | 239/71 |
| 4,614,300 | 9/1986 | Falcoff | 239/71 |
| 4,668,948 | 5/1987 | Merkel | 239/71 X |

FOREIGN PATENT DOCUMENTS

| | | | |
|---|---|---|---|
| 0082465 | 6/1983 | European Pat. Off. . | |
| 0087391 | 8/1983 | European Pat. Off. . | |
| 0100886 | 2/1984 | European Pat. Off. . | |
| 2045142 | 3/1971 | Fed. Rep. of Germany . | |
| 3303030 | 8/1984 | Fed. Rep. of Germany | 68/200 |
| 2139999 | 1/1973 | France | 68/200 |
| 2093738 | 9/1982 | United Kingdom | 68/200 |

*Primary Examiner*—Philip R. Coe

*Attorney, Agent, or Firm*—Herbert Dubno

[57] ABSTRACT

In a method and device for the application of foamed or non-foamed flowable substances upon a substrate, where the quantity of the substance to be applied in function of the surface units to be coated is preselected, the flow rate of the material dispenser to the applicator is controlled by a control element and the quality of application is insured by measurements of the application pressure.

4 Claims, 2 Drawing Sheets

METHOD AND DEVICE FOR APPLYING A FLOWABLE SUBSTANCE

CROSS REFERENCE TO RELATED APPLICATIONS

This application is a national phase application corresponding to PCT/AT85/00028 filed Aug. 29, 1985 and based in turn on Austrian national application A2805/84 filed Aug. 31, 1984.

FIELD OF THE INVENTION

The invention relates to a method for the application of foamed or non-foamed flowable materials to an article, whereby the substance under pressure is supplied to a coating device and is applied by the coating device to the article. The invention also relates to a device for carrying out the method.

BACKGROUND OF THE INVENTION

When applying a flowable substance to an article or substrate, it is required that, with identical substrate quality and identical substance quality, or in the case of coloring, with the same color concentration, the result of the application always be the same. This means that one always must be certain to apply exactly the same quantity of substance in the same manner (superficially or in-depth), from the first to the last produced meter of the substrate coated. It is also desirable to reach this goal at any production speed so that all textile finishing processes can be effected with variable speed but constant quality results. The printer, dyer, application operator, or finisher at the machine should not have to be the one to empirically adjust the production quality and be reponsible therefor. He should define and adjust the optimal speed from the technical point of view of the process and optimize the general process flow of all steps such as printing, steaming, washing, drying and the like. It is also to be considered that with today's production speed and working widths, which can reach 5 m and more, the operator of the machine is hardly capable of intervening quickly to control such a process, so that the danger of producing massive amounts of rejects is present.

OBJECT OF THE INVENTION

It is the object of the present invention to provide an improved coating method and device which obviate the above-mentioned problems.

SUMMARY OF THE INVENTION

The quantity applied to the substrate per surface unit depends on the substrate quality, the quality of the applied substance and the degree of coating, where patterns are used. The main requirements for an application device are the capacity to predetermine the quantity of substance to be applied, to maintaining reproducibility, and to ensure the uniformity of the applied substance over the width and length desired. The departure point is a closed-circuit system, wherein the substance to be applied is delivered under pressure by a pressure-producing device up to the area where the application starts, whereby a counterpressure builds up due to the sealing pressure at the exit opening, or whereby a counterpressure results solely due to the exit opening and the duct system, or the friction- and flow resistance of the friction system.

In accordance with the invention, it is now proposed that, in the case of a predetermined quantity of the substance unit of surface area, to control the flow rate of the substance dispenser to the applicator, depending on the speed, by means of a control element, and to ensure the quality of the application, by measuring the application pressure, at a plurality of measuring points, in any case.

The device for carrying out this process is characterized by the fact that at least one measuring point for the application pressure is provided between the outlet of the applicator and the substance dispenser, or in an overflow duct.

With the aid of the invention it has been possible to obtain predeterminable, and preselectable application results, under varying circumstances, particularly with speeds varying between zero and a maximum speed, and namely for all kind of substances and for all kind of application modes, superficial or in-depth, and also the width of application can be varied. The device according to the invention is at once a measuring, controlling the adjusting device and can be utilized for all flowable media, as well as for aqueous, fluid, viscous or foamed substances.

BRIEF DESCRIPTION OF THE DRAWING

The invention is now described in greater detail, with reference to the drawing in which.

SPECIFIC DESCRIPTION

Figure 1:
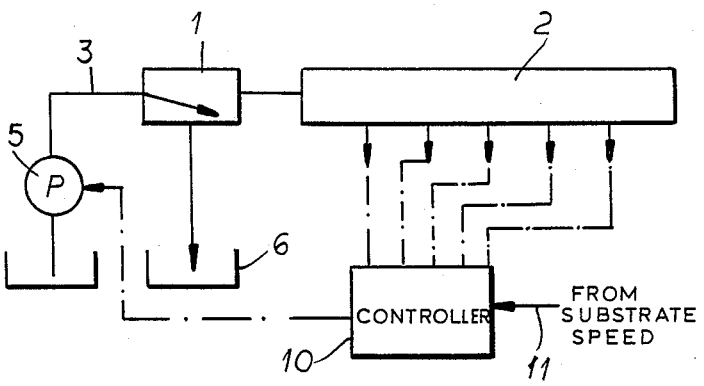
FIGS. 1 and 2 show schematically two devices of the invention.

The substance to be applied is delivered to the applicator 2 by the duct 3 from a pump 5. This applicator has an exit slit, from which the substance to be applied exits onto the article which has not been shown in FIGS. 1 and 2. The dispensing device can also be a foaming device, when the substance is to be of a foamy nature. In FIG. 1, immediately before the entrance of the duct 3 in the applicator 2, a valve 1 is provided, which rerouts an excess of the substance to be applied towards a receptacle 6.

Figure 2:
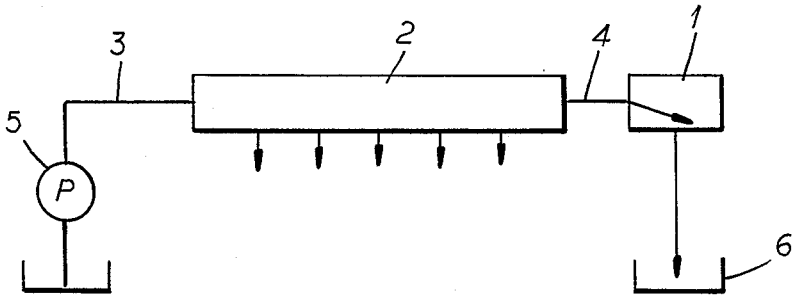

In FIG. 2, the excess of the substance to be applied flows through the applicator 2 and exits via the duct 4 and from there to the valve 1, wherefrom these excess quantities are directed towards the recipient 6.

The valve 1 responds to the application pressure and opens when this application pressure surpasses a given value. In this case, the excess quantity is evacuated from the applicator system and at the same time the measured value of the pressure can be translated into a signal value by the controller, which then acts upon the pressure source 5, for instance a pump, or upon a foam generator and controls the dispensed quantities. On the other hand, the signal value of the pressure measurement can also act upon the speed control of the substrate. As another second component 11 for the control of the quantities which are dispensed, the measurement of the substrate speed can be used, for instance with the aid of an electric speed indicator.

The application pressure can be measured not only immediately before the supply duct 3 enters the applicator 2, but also close to the exit slit of the applicator 2. Over the exit slit, a plurality of measuring points can be distributed. These measuring points can act again upon the dispensing device in given cases, via a digital unit, so that the flow of the dispensing device can be modified in concordance with the application pressure.

It is also possible to provide a measuring element at both ends of the exit slit of the applicator 2, in order to establish whether differences in pressure appear at the left and right margins of the application surface, and, if such pressure differences occur, to take immediate action.

Figure 3:
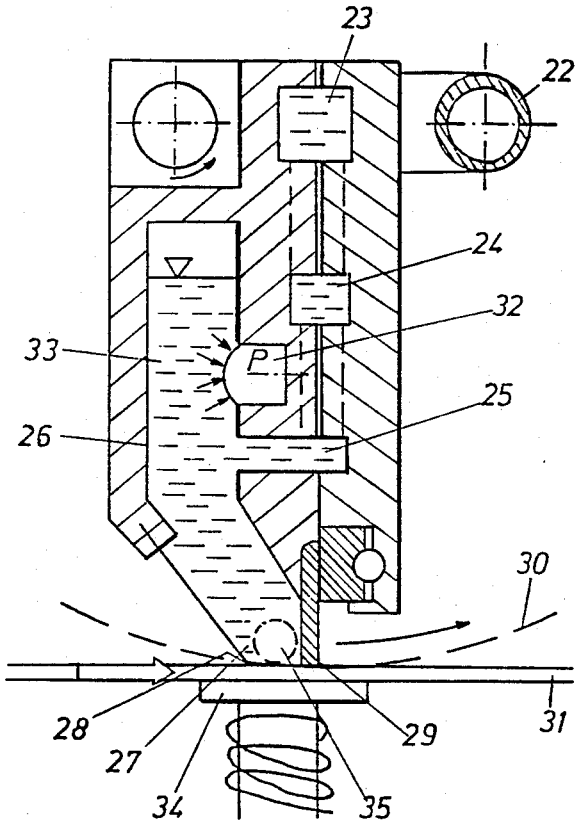
FIG. 3 shows a possible application device in section.

In FIG. 3, a section through a possible applicator device according to the invention is represented. The substance to be applied enters a channel 23 through a duct 22, the first being connected to a branching system of channels 24. These channels have an increasingly smaller diameter and this way the substance is distributed over the entire width of applicator. Finally the substance 33 reaches, via a plurality of exits 25, a hollow space 26 which opens towards the exit slit 27, whose edges 28 and 29 are pressed against the pattern 30 or the substrate path 31 by magnetic force. The measuring points 32 are connected to the hollow space 26. It is possible to mount in the exit slit 27 a revolving wiper 35, which is pressed against a countersurface 34 by magnetic force.

The variable width of the exit slit is important for the technique of the operation, since a wider slit together with a lesser application pressure lead to an ampler surface coating. A narrow slit and high application pressure strengthen the in-depth effect.

The device according to the invention can be operated with manual, as well as automatic control. In the case of manual control, the foam generator is set to an empirically established efficiency value (desired foam weight and predictably required foam quantities) and the foam weight is measured at the opened pressure-controlling or overflow valve. The foam-controlling valve is set to a preselected application pressure, and, as soon as this application system pressure is reached, the pressure or coating machine is connected and accelerated, until the amount of foam produced by the foam generator is completely used up. When automatic control is used, the foam generator is set to the desired weight of foam per liter and it pushes the foam with minimal effort up to a three-way foam valve. The application pressure for the minimal speed and for the planned production speed is preestablished. As soon as in the application device the preselected pressure is reached, the minimal speed is automatically increased to the planned production speed, whereby the amount of foam supplied by the foam generator is constantly compared to the speed of the machine and controlled. In case of machine stoppage, the foam valve is automatically opened, so that no overpressure can occur in the application device.

We claim:

1. A method of applying a flowable medium selected from the group which consists of liquid and foam media to a substrate which comprises the steps of:

(a) displacing a substrate past an elongated applicator extending transversely across the path of said substrate, over the full width thereof and above the latter, said applicator having an inlet and an elongated outlet opening downwardly onto said substrate;

(b) feeding said flowable medium under pressure from a variable-delivery-rate source of said flowable medium to said inlet; and (c) maintaining a given rate of application of said flowable medium per unit surface area of said substrate by:

($c_1$) measuring said pressure within said applicator at at least one location close to said outlet opening, and ($c_2$) controlling the output of said source in response to the pressure measured in step ($c_1$).

2. The method defined in claim 1 wherein the measurement of said pressure within said applicator in step ($c_1$) is one component for control of the output of said source in step ($c_2$) and another component for control of the output of said source is derived from measurement of the speed of said substrate along said path.

3. The method defined in claim 1 wherein said pressure is measured within said applicator at opposite ends of said outlet opening.

4. An apparatus for applying a flowable medium selected from the group which consists of liquid and foam media to a substrate, said apparatus comprising:

an elongated applicator extending transversely across the path of a moving substrate over the full width thereof and above said substrate, said applicator having an inlet and an elongated outlet opening downwardly onto said substrate;

a variable-delivery-rate source of said flowable medium connected to said inlet for feeding said flowable medium under pressure to said applicator whereby said flowable medium is discharged under pressure from said elongated outlet opening onto said substrate;

means in the interior of said applicator directly upstream of said outlet opening and including at least one pressure sensor for measuring the pressure of said flowable medium; and means connected to said pressure measuring means and responsive to the measured pressure of said flowable medium for controlling the output of said source for maintaining a given rate of application of said flowable medium per unit surface area of said substrate.

* * * * *

UNITED STATES PATENT AND TRADEMARK OFFICE

CERTIFICATE OF CORRECTION

PATENT NO. : 4,833,748

DATED : 30 May 1989

INVENTOR(S) : Johannes ZIMMER

It is certified that error appears in the above-identified patent and that said Letters Patent is hereby corrected as shown below:

On the title page:

Item [75] Second Inventor's name to be deleted.

Signed and Sealed this

Fifteenth Day of May, 1990

*Attest:*

HARRY F. MANBECK, JR.

*Attesting Officer*

*Commissioner of Patents and Trademarks*